US006411036B1

(12) United States Patent
Bugenske

(10) Patent No.: US 6,411,036 B1
(45) Date of Patent: Jun. 25, 2002

(54) SUPPORT WIRE FOR CENTERING CERAMIC METAL HALIDE ARCTUBES INSIDE PAR CAPSULES

(75) Inventor: Matthew A. Bugenske, Cleveland Heights, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/466,614

(22) Filed: Dec. 17, 1999

(51) Int. Cl.[7] ..... H01J 61/04

(52) U.S. Cl. ..... 313/623; 313/292

(58) Field of Search ..... 313/623, 292, 313/631, 634

*Primary Examiner*—Vip Patel
(74) *Attorney, Agent, or Firm*—Fay, Sharpe, Fagan, Minnich & McKee, LLP

(57) ABSTRACT

A ceramic metal halide lamp assembly (A) includes an elongated support or member wire (70) that provides both electrical connection and centering of the arctube within the lamp assembly. The support wire has at least one bent region (80) that extends over at least ninety degrees of the inner circumference of the capsule. Preferably, the bent region is disposed between the pinch seal region and the arc chamber so that it does not adversely impact on the desired beam pattern of the lamp assembly.

19 Claims, 2 Drawing Sheets

SUPPORT WIRE FOR CENTERING CERAMIC METAL HALIDE ARCTUBES INSIDE PAR CAPSULES

BACKGROUND OF THE INVENTION

1. Field of the Invention

The present invention relates generally to lighting, and more particularly to a ceramic metal halide or arc discharge lamp.

2. Discussion of the Art

Lamp assemblies incorporating a ceramic metal halide arctube are known in the art. For example, a PAR 20 or a PAR 30 lamp refers to a ceramic metal halide arctube received in a capsule mounted in a housing. The light source or arctube is located at the focal point of a parabolic reflective surface to direct light outwardly through a cover or lens at an open end of the housing. The metal halide arctube is a double-ended structure in which first and second legs of the arctube are typically aligned along the longitudinal axis of the housing. The arctube is hermetically sealed within the light transmissive capsule, typically, a quartz material construction. The capsule has electrical connectors or leads that extend outwardly from one end of the capsule for connection with an external power source via, for example, a first contact or threaded shell and a second contact or central eyelet. The external source provides an electrical potential through the parallel outer leads which are connected to a pair of molybdenum foil components sealed (for example, pinch sealed) at the capsule end. The opposite end of the molybdenum foils are electrically connected to arctube leads extending from the legs of the arctube. Thus, due to the elongated double-ended structure of the ceramic metal halide arctube, a frame component or support wire extends from connection with one of the molybdenum foils, and extends in offset, parallel relation to the longitudinal axis of the housing and arctube. It is electrically connected to the arctube lead at the outer end. The capsule is typically tubulated at the outer end that allows the capsule to be exhausted to vacuum levels after pinch sealing the other end of the capsule. The tubulation also helps to center the arctube within the capsule by accommodating a terminal end of the arctube lead inside the tubulation.

Although helpful in aligning or centering the arctube relative to the capsule, and thus relative to the reflector housing, extending the arctube lead into the tubulation for centering purposes increases the overall length of the capsule. That design provides a certain nominal insertion of the arctube lead into the tubulation, plus a nominal spacing between the end of the arctube lead and the tubulation tip-off. Due to these design considerations, use of existing capsules in smaller packages is essentially precluded.

Alternative approaches to arctube centering have been considered with regard to other lamps, but the above described tubulation centering technique has been used exclusively with ceramic metal halide lamps. However, these other approaches suffer from their own problems. For example, a circular wire component or "halo" can be welded to a straight wire. The halo serves a centering function of an arctube within a shroud.

Another consideration is to weld first and second thin strips of metal bent into cords whose radii are similar to the inner diameter of the shroud onto the frame component. Again, the necessity for welding the parts to the support lead is undesirable. Likewise, additional material used to center the arctube should be minimized to prevent distortion or shadowing in the beam pattern created by the light source inside the reflector.

Accordingly, a need exists for an effective, economical solution to centering or aligning a ceramic metal halide arc tube within the capsule that overcomes the noted problems and others.

BRIEF SUMMARY OF THE INVENTION

A ceramic metal halide lamp assembly includes an elongated arctube that includes first and second arctube leads extending from first and second ends, respectively. The arctube is hermetically sealed within a light transmissive capsule having first and second electrical connectors extending through a first end thereof An elongated support member or support wire electrically connects the second arctube lead with the second electrical connector and includes a bend region that extends in a circumferential direction dimensioned for abutting receipt within the capsule to provide a centering function of the arctube within the capsule.

An exemplary embodiment includes a bend region comprised of first and second portions spaced from each other.

In an exemplary embodiment, the bend region is located closer to the first end of the capsule than the second end to prevent distortion or shadowing in the beam pattern.

DETAILED DESCRIPTION OF THE INVENTION

Figure 1:
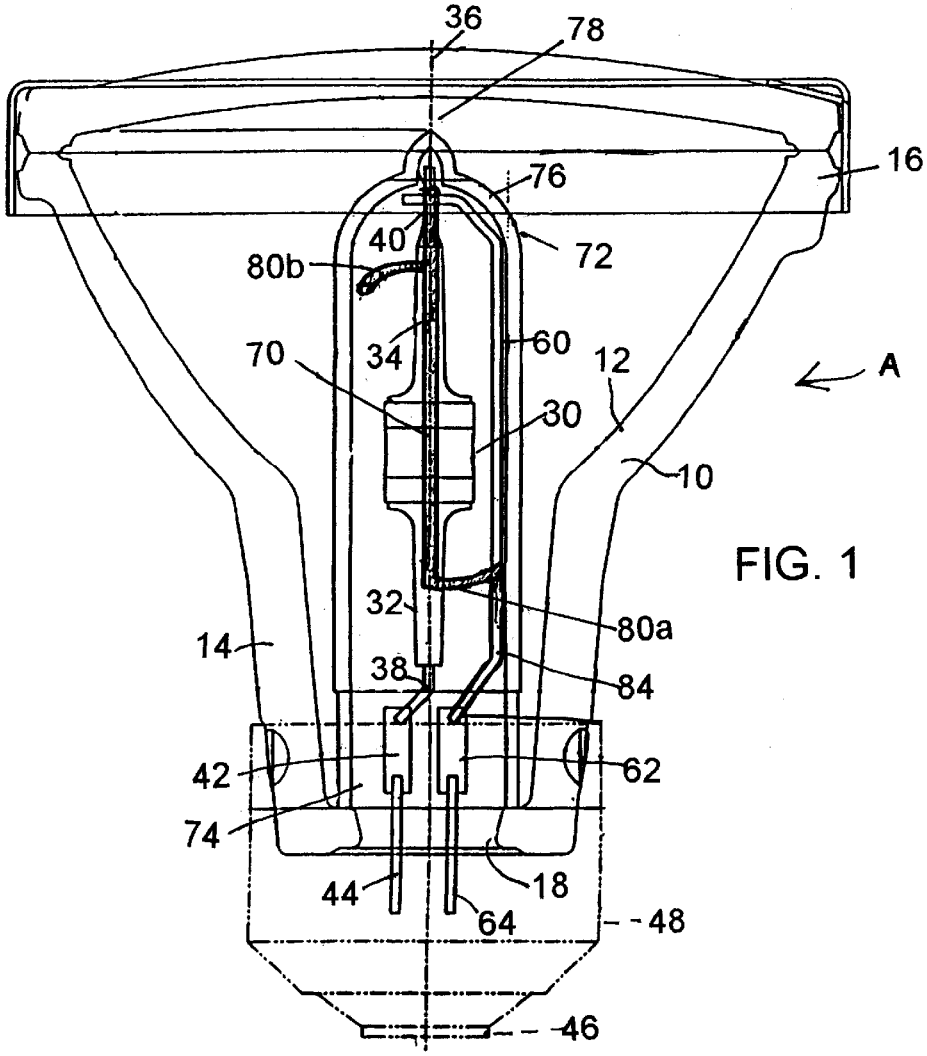
FIG. 1 is an elevational view with selected components shown in cross-section.

A ceramic metal halide lamp assembly A is shown in FIG. 1. It includes a housing 10 having an internal, reflective surface 12 that extends from a neck portion 14 at a first end to a larger diameter or outer end portion 16 at a second end. An opening 18 is provided in the neck portion. A lens or covering 20 is disposed over the outer end portion and preferably seals that end of the housing.

A ceramic metal halide arctube 30 is a double-ended discharge tube that has first and second legs 32, 34, generally aligned with a longitudinal axis 36 of the lamp assembly. Ceramic discharge lamp chambers were developed to operate at higher temperatures, i.e., above 950° C., for improved color temperatures, color rendering, and luminous efficacies. The structure and operation of these type of light sources are generally known in the art so that further discussion is deemed unnecessary to a full and complete understanding of the present invention. Extending from the first and second legs 32, 34 are first and second arctube leads 38, 40, respectively. The first arctube lead 38 is directly connected to a first molybdenum foil 42 that, in turn, is connected to a first outer lead 44. The outer lead is either connected to a first contact or eyelet 46 or a second contact or threaded shell 48 to establish electrical connection with a standard lamp socket (not shown), as is well known in the art. The second arctube lead 40, on the other hand, is disposed adjacent the outer end of the lamp assembly, i.e., away from the neck portion of the lamp assembly. Shown in phantom, and identified by reference numeral 60 is a conventional support member or support wire. It mechanically and electrically interconnects the second arctube lead 40 with the second molybdenum foil 62 that is electrically connected to the second outer lead 64.

Figure 4:
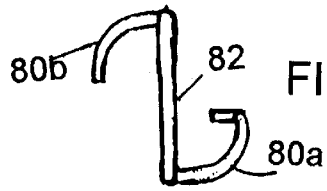
FIG. 4 is a top plan view of the support wire of FIG. 2.
Figure 2:
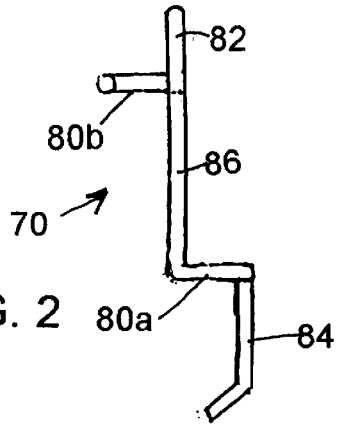
FIG. 2 is an elevational view of a first exemplary embodiment of the inventive support wire.
Figure 3:
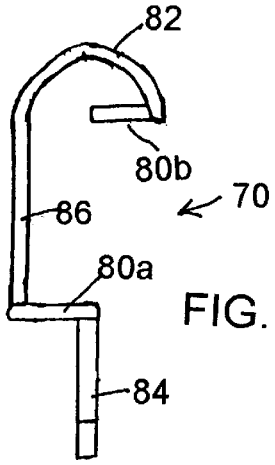
FIG. 3 is an elevational view taken generally from the right-hand side of FIG. 2.

A new support member or support wire 70 is shown in solid line. It, too, is connected to the second arctube lead 40. The support wire also supports the arctube within capsule 72 in an advantageous manner to be described below. The capsule has a first end 74 defining a seal region, which in an exemplary embodiment is defined by a pinch seal around the molybdenum foils 42, 62. The opposite end of the capsule defines a tubular portion or tubulation 76. It includes a tip 78 which heretofore received the outer terminal end of the second arctube lead for centering purposes. However, in accordance with an exemplary embodiment of the present invention, the tip can be reduced in height or eliminated in its entirety since the centering function is no longer necessary at that end. Instead, the support wire 70 includes a bend or bent region 80. As shown in FIG. 1, and additionally represented in FIGS. 2–4, a first embodiment of the lead wire has at least two circumferential bent regions 80*a*, 80*b*. These regions are axially spaced from one another, and as illustrated in FIG. 4, are also circumferentially spaced apart. Each region 80*a*, 80*b* extends over approximately 90°. They are curved or bent to conform to the inner surface of the capsule. The bent regions thus provide a centering function of the arctube relative to the capsule. In this manner, the arctube can be aligned with the longitudinal axis of the reflector housing. Moreover, it eliminates the use of any welds or any extra components which add to both manufacturing and overall cost, as well as increased steps of assembly and the potential for failure. Here, the support wire 70 is an integral or one-piece, homogenous member that is bent to the desired configuration shown in FIG. 2–4. In addition to the bent regions 80*a*, 80*b*, the support wire also includes curved portion 82 at the second end that generally conforms to the tubular portion 76 of the capsule.

As will be appreciated, the support wire 70 provides both mechanical support and electrical connection between the second arctube lead 40 and the second molybdenum foil 62. It also preferably positions the bent regions 80*a*, 80*b* at areas away from the arc discharge chamber. This reduces shadowing or distortion that would otherwise occur in the beam pattern associated with the lamp.

Thus, as illustrated in FIGS. 1–4, a first exemplary embodiment of the support wire disposes the bent regions 80*a*, 80*b* at generally diametrically opposite portions of the capsule. The support wire extends from a connection with the molybdenum foil and angles outwardly into a generally linear portion 84. This merges into the first bend region 80*a* and into a second linear portion 86. The linear portion 86 merges into the second curved region 82 adjacent the second arctube lead. The second arctube lead is preferably electrically connected with the curved region 82. The lead wire 70 then terminates in the second bent region 80*b*.

Figure 8:
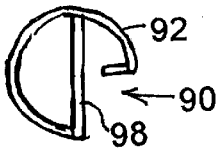
FIG. 8 is a top plan view of the support wire of FIG. 6.
Figure 6:
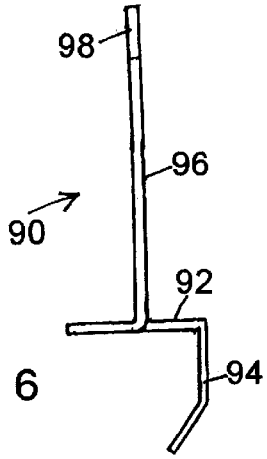
FIG. 6 is an elevational view of the second exemplary embodiment of the support wire.
Figure 7:
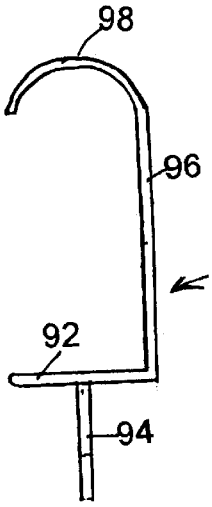
FIG. 7 is an elevational view taken generally from the right-hand side of FIG. 6.
Figure 5:
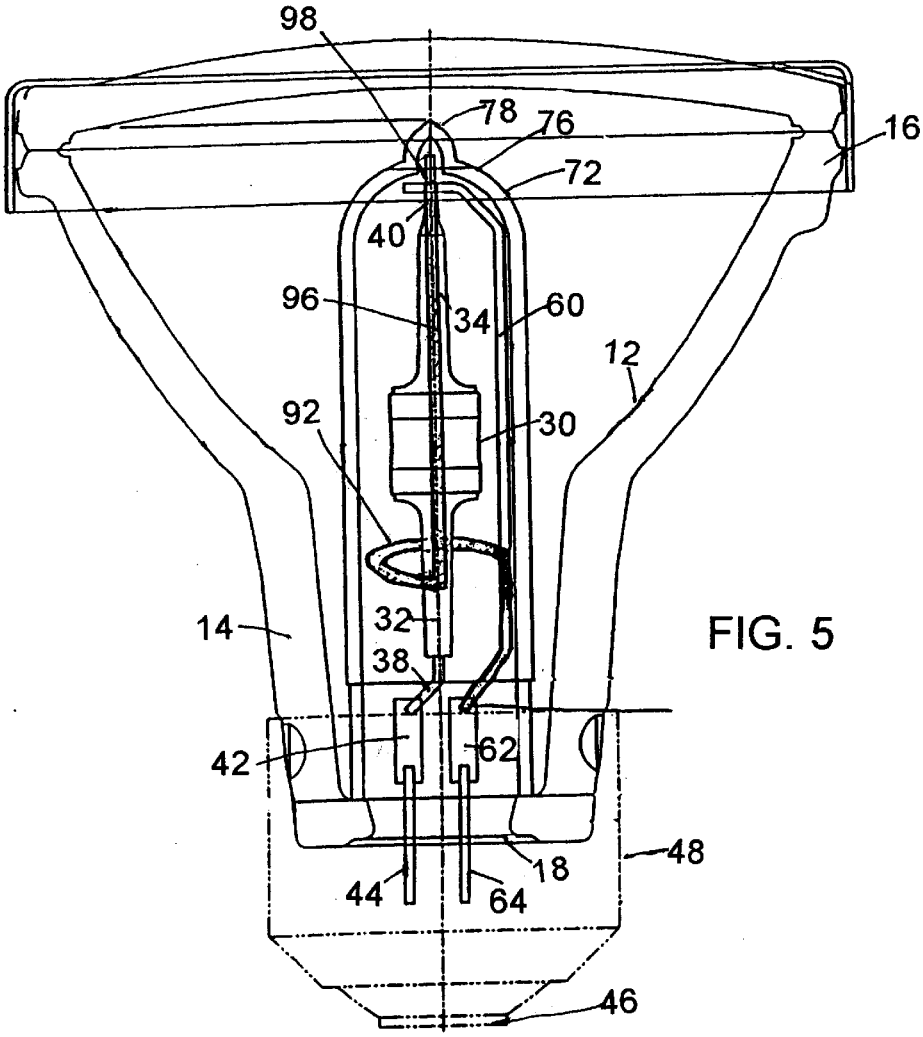
FIG. 5 is an elevational view of a second exemplary embodiment with selected components shown in cross-section.

FIG. 5 represents another exemplary embodiment of a single or one-piece, homogenous lead wire 90. It includes a single bent region 92 that is interposed between linear portions 94, 96. As will be appreciated in FIG. 8, the bent region extends circumferentially over 270°. It is also dimensioned for receipt in the capsule, and provides the desired centering function to align the arctube with the longitudinal axis of the reflector housing. The entire bent region 92 is preferably disposed between the seal region of the capsule and the arc discharge chamber or if located on the lens side of the light source at a location remote from the focal point. Again, this limits any adverse effect with the desired beam pattern, thereby reducing shadowing or distortion that would otherwise occur. A second curved region 98 extends from the second linear portion and conforms to the tubular portion 76 of the capsule.

The invention as shown and described relative to the exemplary embodiments provides a lead wire that establishes electrical connection to the arctube.

Secondly, the support wire centers the arctube in the capsule. The design is a single frame part that does not require additional parts to be welded thereto to provide the centering function. The invention also preferably locates the centering function on the pinch-side of the arc discharge chamber or capsule near the arctube first leg. By placing the centering mechanism in this region, the centering mechanism is preferably located below the focal length of the reflector so that it does not contribute to shadowing in the reflector's beam path. This arrangement also permits the tubulation to be located at a different position on the capsule. Rather than requiring the exhaust to be positioned at the end of the capsule opposite the pinch seal region, the present invention accommodates the exhaust at a variety of locations.

The invention has been described with reference to the preferred embodiments. Modifications and alterations will occur to others upon reading this specification. The invention is intended to cover such modifications and alterations insofar as they fall within the scope of the appended claims or the equivalents thereof.

What is claimed is:

1. In a ceramic metal halide lamp assembly including an elongated arctube having first and second arctube leads extending from first and second ends respectively, the arctube hermetically sealed within an elongated light transmissive capsule having first and second electrical connectors extending through a first end of the capsule, an elongated support member electrically connecting the second arctube lead with the second electrical connector, the support member including a bend region that extends in a circumferential direction and is dimensioned for abutting receipt with the capsule to provide a centering function of the arctube within the capsule.

2. The invention of claim 1 wherein the bend region includes a first portion that extends over approximately ninety degrees.

3. The invention of claim 2 wherein the bend region includes a second portion that extends over approximately ninety degrees.

4. The invention of claim 3 wherein the first and second portions of the bend region are spaced from each other.

5. The invention of claim 4 wherein the first and second portions of the bend region are axially spaced from each other.

6. The invention of claim 4 wherein the first and second portions of the bend regions are circumferentially spaced from each other.

7. The invention of claim 1 wherein the bend region extends over approximately two hundred seventy degrees.

8. The invention of claim 1 wherein the bend region is disposed closer to the first end of the capsule than the second end.

9. The invention of claim 1 wherein the bend region includes a first portion disposed adjacent the first end of the capsule and a second portion disposed adjacent the second end of the capsule.

10. A ceramic metal halide lamp assembly comprising:

an elongated double ended arctube having a first lead extending from a first end and a second lead extending from a second end;

a capsule dimensioned to receive the arctube therein having a seal and include first and second electrical connectors that proceed through the seal end and a tubulation end that receives the second lead of the arctube; and a support wire that is electrically connected to the second lead adjacent the tubulation end and to one of the electrical connectors at the seal end, the support wire including a bent region that is curved to conform to an inner surface of the capsule for centering the arctube therein.

11. The lamp assembly of claim 10 wherein the wire bent region includes a first portion that proceeds over at least approximately ninety degrees.

12. The lamp assembly of claim 11 wherein the first portion of the bent region is disposed adjacent the tubulation end of the capsule.

13. The lamp assembly of claim 11 wherein the support wire bent region includes a second portion that proceeds over at least approximately ninety degrees.

14. The lamp assembly of claim 13 wherein the second portion is axially spaced from the first portion.

15. The lamp assembly of claim 14 wherein the second portion is circumferentially spaced from the first portion.

16. The lamp assembly of claim 13 wherein the second portion is circumferentially spaced from the first portion.

17. The lamp assembly of claim 16 wherein the first portion is disposed adjacent the tubulation end of the capsule away from a light generating region of the arctube.

18. The lamp assembly of claim 16 wherein the second portion is disposed adjacent the seal end of the capsule away from a light generating region of the arctube.

19. The lamp assembly of claim 10 wherein the support wire is a one-piece homogenous component.

* * * * *